US006090021A

United States Patent [19]

Flowers et al.

[11] Patent Number: 6,090,021

[45] Date of Patent: Jul. 18, 2000

[54] TOY EXERCISE BENCH

[75] Inventors: Danny J. Flowers; David M. Grebler, both of St. Louis, Mo.

[73] Assignee: Grebler & Associates, Inc., St. Louis, Mo.

[21] Appl. No.: 09/169,464

[22] Filed: Oct. 9, 1998

[51] Int. Cl.[7] ..... A63B 22/08; A63B 21/055; A63B 21/072

[52] U.S. Cl. ..... 482/104; 482/57; 482/97; 482/130; 482/138; 482/142

[58] Field of Search ..... 482/57, 62, 93, 482/104, 106, 108, 97, 129, 130, 133, 138, 142; D21/690

[56] References Cited

U.S. PATENT DOCUMENTS

| | | | |
|---|---|---|---|
| 1,070,422 | 8/1913 | Creque . | |
| 1,485,577 | 3/1924 | Witten . | |
| 2,644,890 | 7/1953 | Hollihan | 250/71 |
| 3,226,115 | 12/1965 | Underhill . | |
| 3,334,899 | 8/1967 | Boskoe et al. . | |
| 3,672,093 | 6/1972 | Meeck, Sr. | 46/47 |
| 4,412,678 | 11/1983 | Baynes | 482/104 |
| 4,477,074 | 10/1984 | Bushnell . | |
| 4,566,691 | 1/1986 | Mahnke . | |
| 4,765,616 | 8/1988 | Wolff | 482/104 |
| 4,792,135 | 12/1988 | Chin-Sen | 482/57 |
| 4,838,547 | 6/1989 | Sterling | 482/104 |
| 4,861,020 | 8/1989 | Soligng | 482/129 |
| 5,346,448 | 9/1994 | Sollo | 482/104 |
| 5,354,249 | 10/1994 | Raley | 482/57 |
| 5,484,367 | 1/1996 | Martinez | 482/107 |
| 5,575,742 | 11/1996 | Wu | 482/142 |
| 5,746,684 | 5/1998 | Jordan | 482/62 |
| 5,749,815 | 5/1998 | Lipps | 482/122 |
| 5,941,805 | 8/1999 | Copelin | 482/104 |

*Primary Examiner*—John Mulcahy
*Attorney, Agent, or Firm*—Grace J. Fishel

[57] ABSTRACT

A toy exercise bench for simulating free weight bench-press exercises together with aerobic pedaling exercises, arm lift exercises, or both. The bench has a frame on which the above-mentioned equipment is compactly mounted.

16 Claims, 5 Drawing Sheets

TOY EXERCISE BENCH

BACKGROUND OF THE INVENTION

1. Field of the Invention

The present invention relates to a toy exercise bench for simulating free weight bench-press exercises together with aerobic pedaling exercises, arm lift exercise, or both.

2. Brief Description of the Prior Art

Many parents are committed to an exercise program involving working out on gym equipment, whether at a club or at home. Fitness can become a family "trait" children feel inspired to live up to, as it is a natural tendency for children to imitate their elders. Exercise can be quality time. Doing fitness activities together as a family, in addition to perpetuating fitness as a "trait," can also help promote communication and emotional closeness that can last a lifetime.

The gym equipment available to adults typically includes a multi-purpose weight bench and various adjustable weight gym machines for weight training and a stationary cycle or treadmill for aerobic exercises, both types of equipment being required for complete cardiovascular, aerobic and anaerobic conditioning and flexibility enhancement training.

There have been hollow toy barbells that can be filled with water or sand that have allowed children to play at doing "arm curls" and the like, but there have been no toys that allow them to play at doing a full range of exercises, preferably both weight training and aerobic, that children may see their parents or older siblings doing. It is to this play opportunity that the present invention is addressed.

BRIEF SUMMARY OF THE INVENTION

In view of the above, it is an object of the present invention to provide a toy exercise bench that allows a child to simulate most of the activities that the user may see a member of his or her family performing in even a very well outfitted gym. It is another object to provide a toy exercise bench that compacts the above-mentioned features into a single toy occupying a small space. Other objects and features of the invention will be in part apparent and in part pointed out hereinafter.

In accordance with the invention, a toy exercise bench has a frame with first and second ends and a generally horizontal top upon which a user can lie or be seated. A free weight exercise device is provided comprising a pair of spaced apart upstanding members and a dumbbell. The upstanding members are at the first end of the frame, each of which has a top end with a cradle for receiving a bar of the dumbbell and supporting it above the top surface of the frame.

The toy exercise bench has an aerobic exercise device, a resistance arm lift exercise device, or both, optionally further including a leg extension exercise device. The aerobic exercise device includes a pair of pedals mounted on crank arms to an axle. The axle is mounted in the frame under the horizontal top, between the first and second ends of the frame.

The resistance arm lift exercise device has a pair of transversely extending, interconnected handles adapted to be engaged by the hands of the user. The handles are connected to an elastic member attached to the frame of the bench under the top surface for imparting progressively increasing resistance as the user pulls the handles closed to the top surface.

The leg extension exercise device includes a support bracket mounted at the second end of the frame and an arm with first and second ends. The first end of the arm is pivoted in the support bracket and the second end of the arm has a pair of transversely extending supports adapted to be engaged by the feet of the user.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 1:
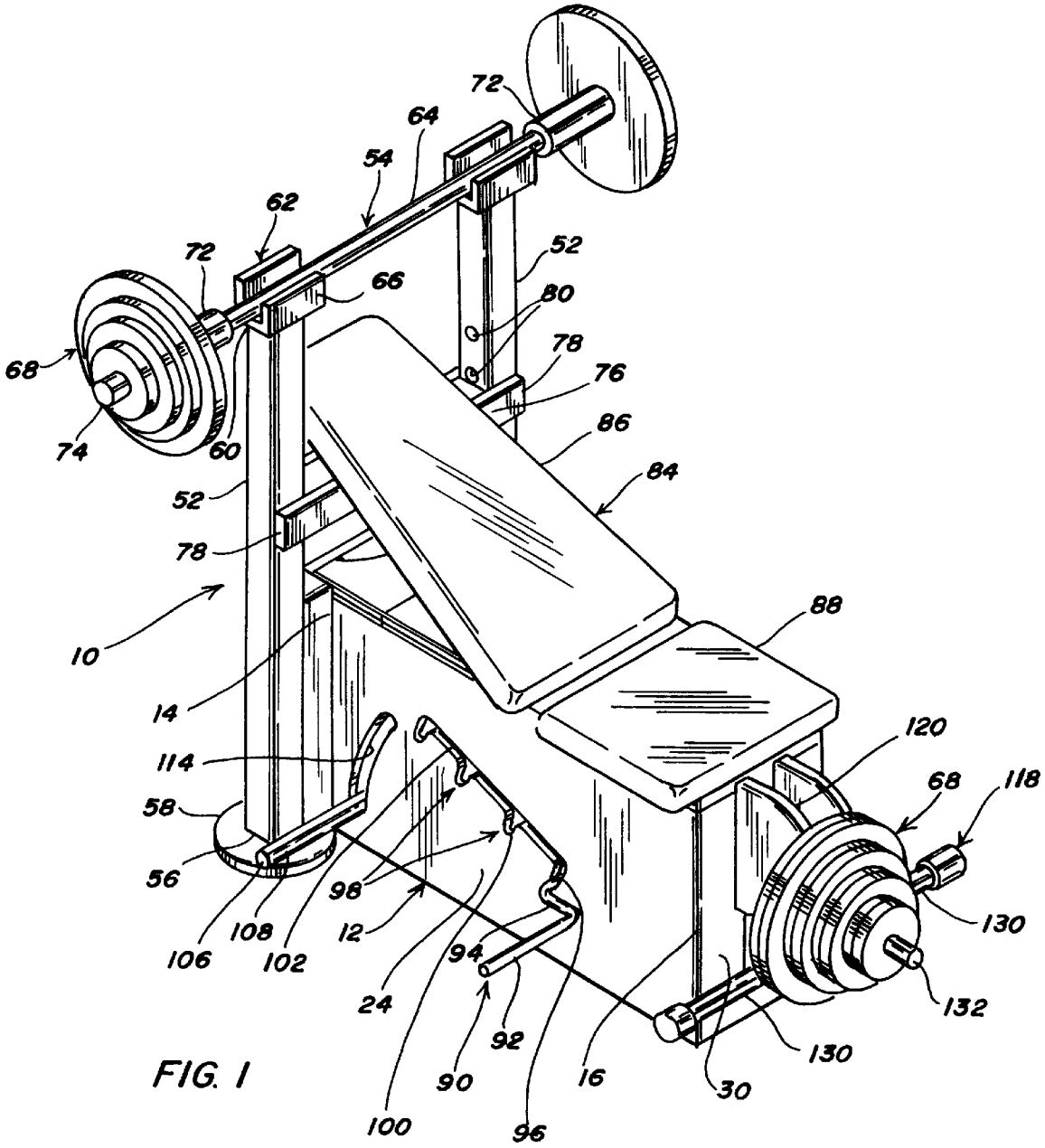
FIG. 1 is a perspective view of a toy exercise bench in accordance with the present invention.

Referring to the drawings more particularly by reference character, reference numeral 10 refers to a toy exercise bench in accordance with the present invention. Bench 10 has a frame 12 with first and second ends 14, 16, respectively and an elongated horizontal top 18 upon which a user 20 can lie or be seated.

In the form illustrated in the drawings, frame 12 is a box, the lid of which serves as horizontal top 18. Frame 12 includes a rectangular bottom wall 22, first and second rectangular side walls 24, 26, respectively, and first and second rectangular end walls 28, 30, respectively. In the embodiment shown in FIG. 6, frame 12 is formed as two wedge-shaped sections, 32, 34, respectively, connected with a hinge 36 provided in second end wall 30. In another embodiment, as shown in the other drawings, a hinge 38 is provided along a top side edge of one of side walls 24, 26 to which top 18 is hinged and frame 12 is not sectioned.

Figure 10:
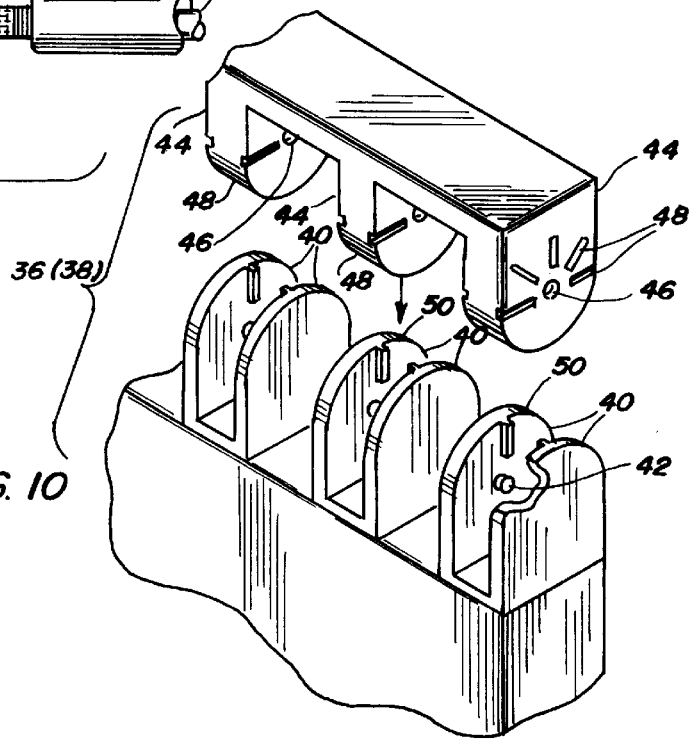
FIG. 10 is a detail, on an enlarged scale, of a hinge.
Figure 5:
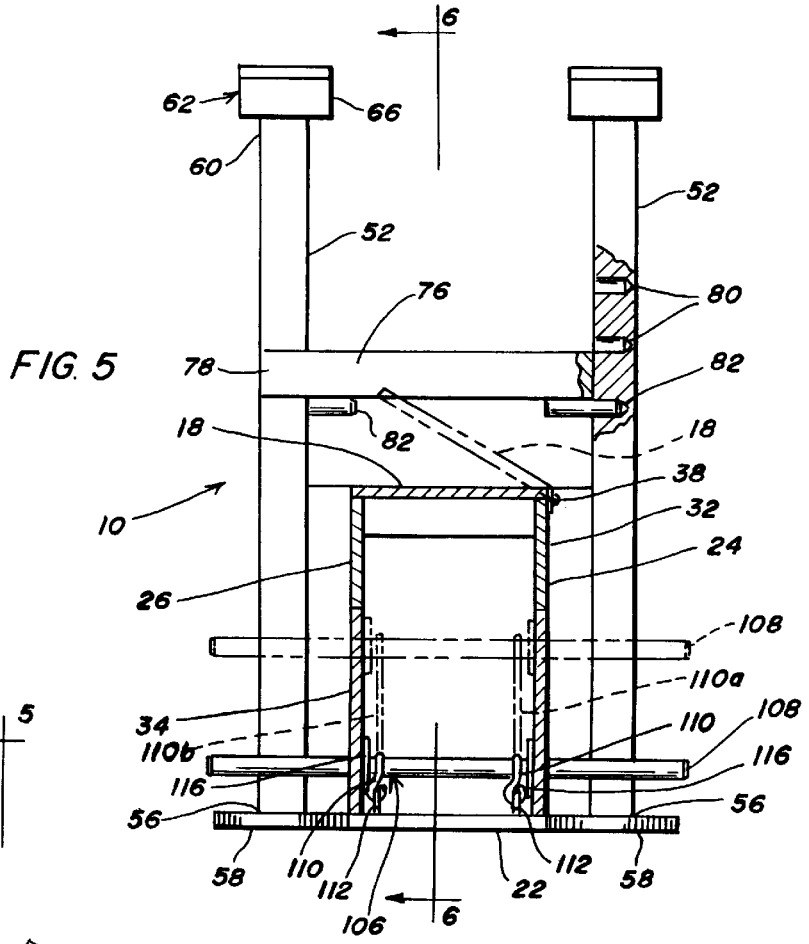
FIG. 5 is a view, partly in section, taken along line 5—5 in FIG. 6.

It is preferred that hinges 36, 38 be somewhat stiff such that hinged upper section 32 or hinged top 18 does not snap closed easily. For this purpose, as shown in FIG. 10, one portion of hinges 36, 38 may comprise a row of U-shaped yokes 40, inner faces of which include a protuberance 42. In this form, the other portion of hinges 36, 38 comprises a row of tangs 44, opposite side faces of which have a dimple 46 for mated receipt in U-shaped yokes 40. Tangs 44, in addition, include a plurality of radially spaced, elongated grooves 48, selected ones of which receive a rib 50 provided on opposite inner faces of yokes 40. As will be readily understood, free movement of hinges 36, 38 is checked as ribs 50 move between grooves 48. It will also be understood that the elements of hinges 36, 38 (e.g., protuberance 42, dimple 46, grooves 48 and rib 50) may be reversed and other equivalent structures substituted.

Bench 10 further includes a pair of spaced apart upstanding members 52 at first end 14 of frame 12 and a dumbbell 54. Upstanding members 52 are positioned on either side of frame 12 and have a bottom end 56 footed on a pad 58 and a top end 60 with a cradle 62 for receipt of a bar 64 of dumbbell 54. Cradles 62 may be U-shaped in cross-section, a leg 66 of which facing user 20 is shorter than the other to facilitate removal of bar 64 from the cradle when the user is reclining on top 18. Cradles 62 support dumbbell 54 at points in between weights 68 carried on either end of bar 64.

Figure 9:
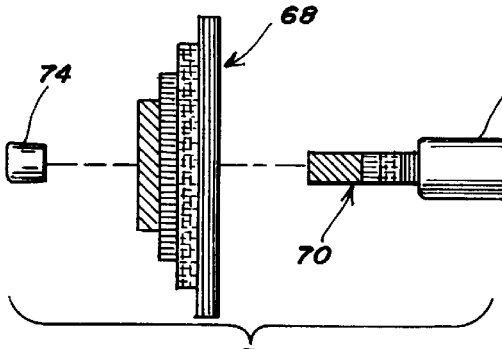
FIG. 9 is a detail, on an enlarged scale, of one end of a dumbbell.

Weights 68 are preferably removable from bar 64, details of which are shown in FIG. 9. As shown in this view, opposite ends of bar 64 have a plurality of colored bands 70 which are color coded with a plurality of discs making up weights 68 for assisting a young user in the proper assembly of the toy. Weights 68 simulate adult weights on an adult dumbbell and may, in some instances, be lightly weighted appropriate for the age of intended user 20. Weights 68 are held at the ends of the bars between an inside collar 72 and an outside collar 74. Collars 72, 74 may be like those found on an adult dumbbell. In the drawings, however, inside collar 72 is formed as a sleeve, which also serves as a handgrip, and outside collar 74 is formed as a cap applied to the end of bar 64. It will be understood that inside collar 72 may be formed as an abutment shoulder by reducing the diameter of bar 64 at the ends. Other such variations will be understood by those skilled in the art as within the functional definition of "collar."

A horizontal cross-bar 76, opposite ends of which are forked 78, is provided between upstanding members 52. Upstanding members 52 are received in forks 78 and cross-bar 76 is vertically adjustable within a selected range. For this purpose, a plurality of spaced apart holes 80 are provided on opposing faces of upstanding members 52 for receipt of pins 82 upon which cross-bar 76 rests. Forks 78 may be closed around upstanding members 52, if desired. A padded seat 84 is preferably provided for top 18. Seat 84 may have a back portion 86 which is hinged to a bottom portion 88. As shown in FIGS. 1–4, back portion 86 may be placed flat on top 18 or tilted at an angle on cross-bar 76 appropriate to the training exercises being simulated by user 20.

Figure 6:
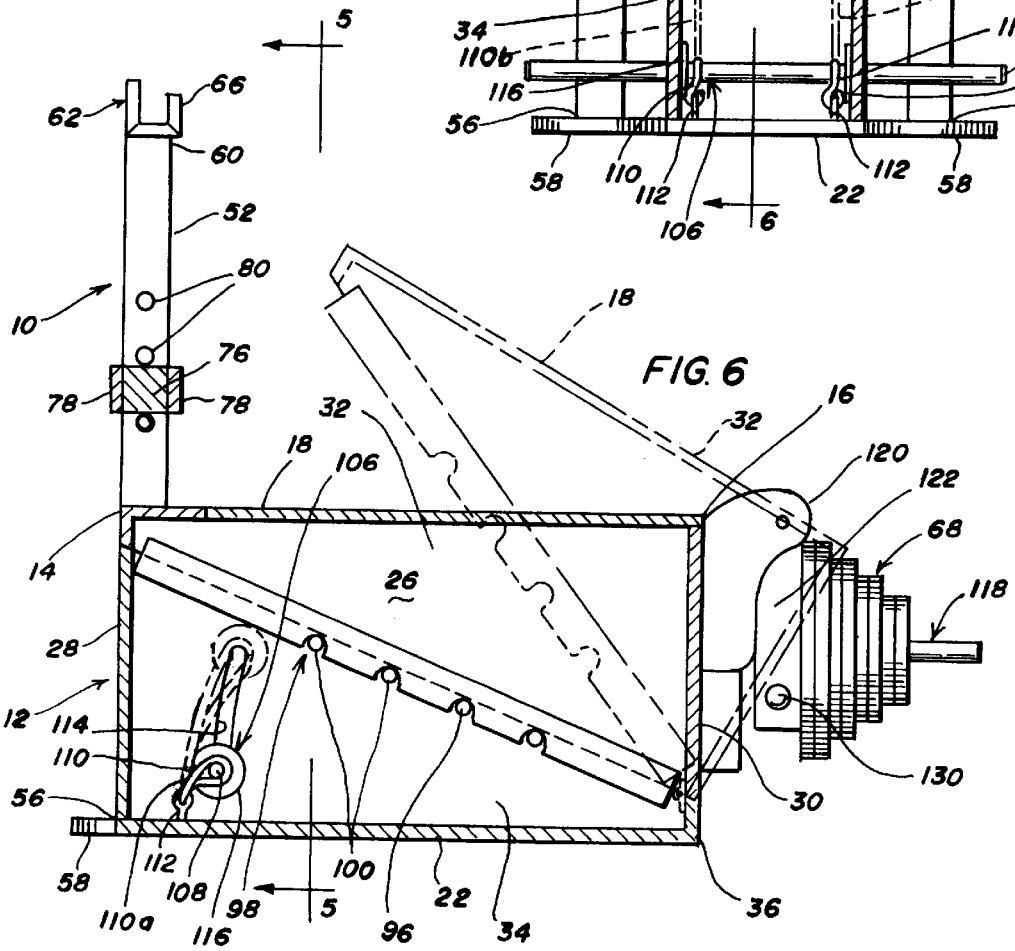
FIG. 6 is a view, partly in section, taken along line 6—6 in FIG. 5.
Figure 7:
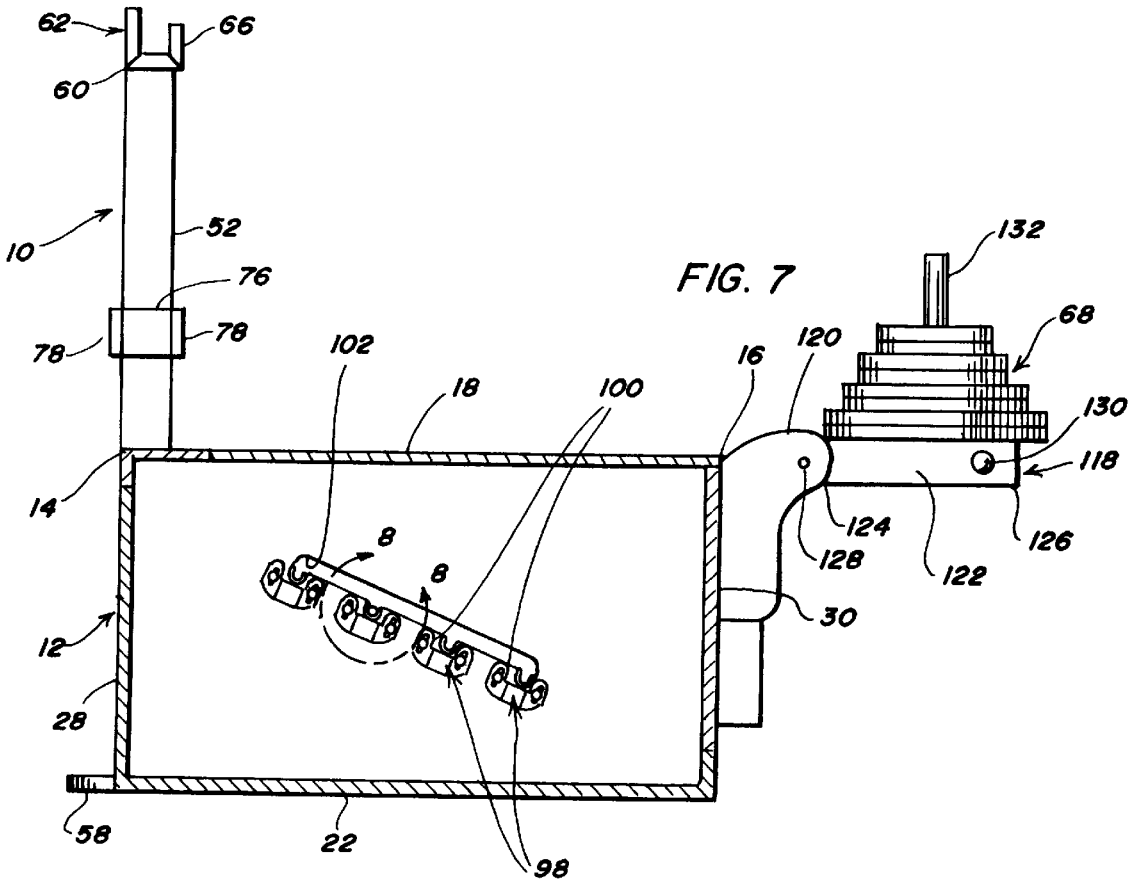
FIG. 7 is a view, partly in section, similar to FIG. 6 of a second embodiment of the bench.
Figure 8:
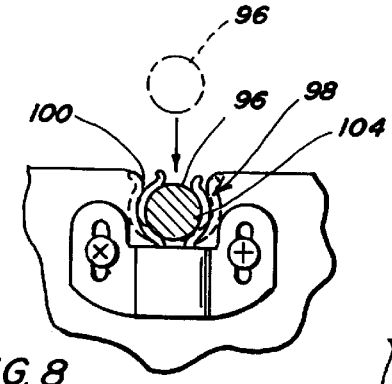
FIG. 8 is a detail, on an enlarged scale, taken along line 8—8 in FIG. 7 showing a first journal.

In a preferred embodiment, bench 10 includes an aerobic exercise device 90 that simulates a windlass or a stationary cycle. Aerobic exercise device 90 includes a pair of pedals 92 mounted on crank arms 94 to an axle 96. Axle 96 is mounted in frame 12 under horizontal top 18 and between first and second ends 14, 16. A brake means, applying a drag on axle 96 may be provided for increasing pedaling force, but in simple form axle 96 is free to rotate in a pair of journals 98 provided in side walls 24, 26. As shown in FIG. 6, journals 98 comprise one or more paired sockets 100 provided along a top side face of lower section 34. When upper section 32 is hinged open as shown in broken lines in FIG. 6, axle 96 may be placed in a selected pair of sockets. When upper section 32 is closed over lower section 34, axle 96 is pinned in the selected pair of sockets 100 by the bottom side face of upper section 32. In the embodiment shown in FIGS. 1–5 and 7–8, frame 12 is not divided into hinged upper and lower sections. An upwardly angled slot 102 is provided in each of side walls 24, 26. Slots 102 are aligned and have a width sufficient for axle 96 with pedals 92 to be passed through the slots, in initial assembly, and axle 96 seated in a selected pair of journals 98. As best seen in FIG. 8, journals 98 include spring clips 104 which retain axle 96 in sockets 100. Clips 104 are attached to the inside of side walls 24, 26 at sockets 100 which are formed in the bottom side edge of slots 102. Clips 104 maintain axle 96 in sockets 100 while user 20 pedals or cranks but axle 96 can be unsnapped from clips 104, slid along slots 102 and placed in another set of paired sockets to adjust aerobic exercise device 90 to the arm or leg length of the user or to vary the feel of the toy.

Figure 8A:
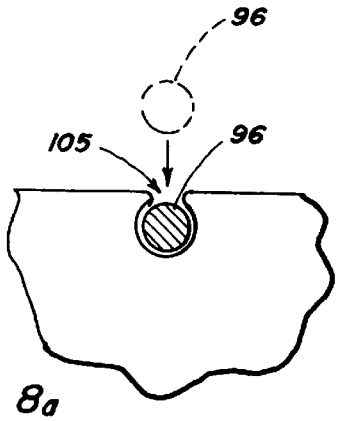
FIG. 8*a* is a detail, similar to FIG. 8, showing a second journal.

As shown in FIG. 8*a*, sockets 100 may form journals 98, in which case sockets 100 have an entryway 105 marginally smaller than the diameter of axle 96. Entryway 105 thus serves as a retainer for the axle but permits user 20 to easily remove the axle from one pair of sockets and place it another set of paired sockets. Sockets 100 with entryway 105 may be integrally formed with the side walls or provided as an insert.

Figure 3:
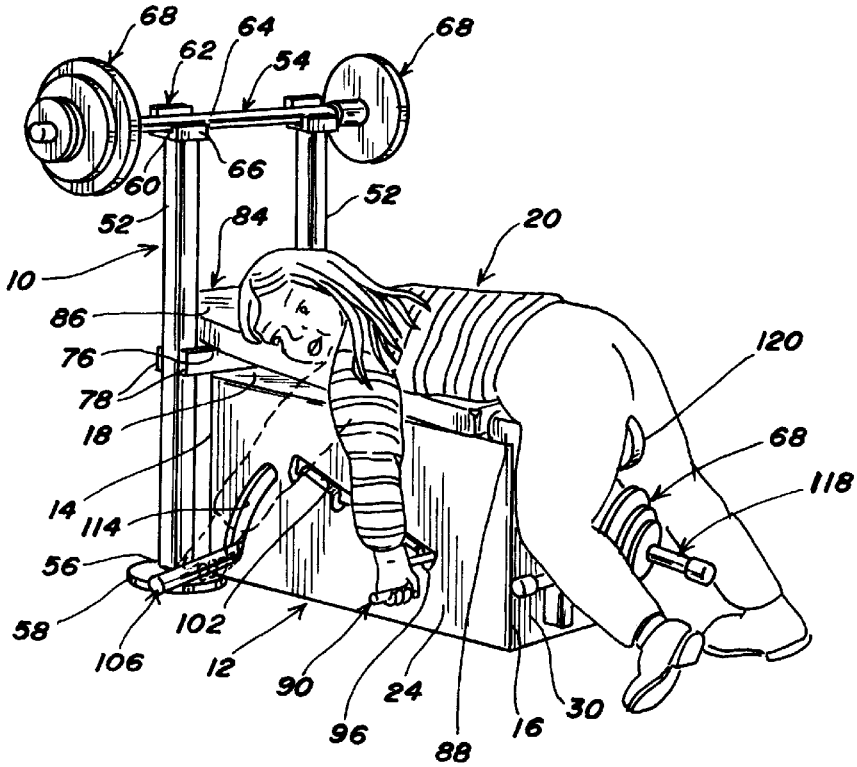
FIG. 3 is a perspective view of the bench showing a user doing windlass arm exercises in full lines and resistance arm lift exercises in broken lines.

In another preferred embodiment of the invention, bench 10 includes a resistance arm lift exercise device 106 for use in doing pull-ups from a prone position as shown in broken lines in FIG. 3. Arm resistance lift device 106 has a pair of transversely extending handles 108 which may be formed from a single rod. Handles 108 are connected to an elastic member 110 attached to frame 12 under top 18 for imparting progressively increasing resistance as user 20 pulls handles 108 closer to top 18. Elastic member 110 may comprise a spring, a pair of pieces of plastic tubing (110*a*, 110*b*) or the like. One end of each piece of tubing 110*a*, 110*b* is tied to an anchor such as eye screw or eye bolt 112 attached to bottom wall 22 along adjacent side walls 24, 26, while the opposite end is tied (or otherwise attached) to the rod forming handles 108. A pair of aligned arcuate slots 114 are provided in side walls 24, 26 through which handles 108 extend outside of frame 12. A washer 116 may be provided on handles 108 on the inside of side walls 24, 26, serving as a guide as handles 108 are raised from a first relaxed position at the bottom of arcuate slots 114 to a second position along arcuate slots 114 (see FIGS. 5 and 6).

Figure 2:
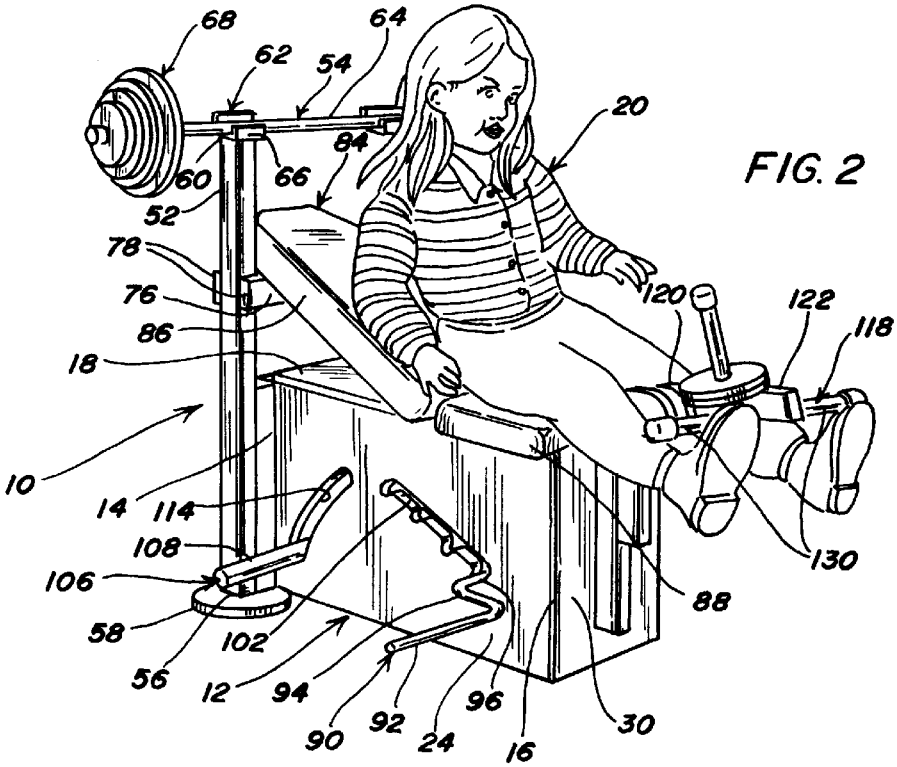
FIG. 2 is a perspective view of the bench showing a user doing leg extension exercises.

In some embodiments, bench 10 may include both aerobic exercise device 90 and resistance arm lift exercise device 106, which features may be further coupled with a leg extension device 118. As illustrated in the drawings, leg extension device 118 is attached to frame 12 at second end 16. Leg extension device 118 includes a U-shaped bracket 120 mounted to second end wall 30 and an arm 122 with first and second ends 124, 126, respectively. First end 124 of arm 122 is pivoted about a pin 128 in bracket 120 and second end 126 has a pair of transversely extending supports 130 adapted to be engaged by the feet of user 20 as shown in FIG. 2. A single rod may form supports 130 passing through a transverse hole in second end 126 for that purpose. A support rod 132 is attached to arm 122 adjacent second end 126 upon which may be mounted one or more weights 68 as discussed above in connection with dumbbell 54. Support rod 132 may have a series of colored bands, color coded to weights 68, for assisting the young user in proper loading of the weights on leg extension device 118.

As discussed above in the Background of the Invention, young children learn more by example than by instruction. Toy exercise bench 10 allows a child to mimic the exercises that he or she may see his mother, father, older sibling or other family member performing to the end of positively disposing the child to a lifelong regimen of healthy exercise.

In use, back portion 86 of padded seat 84 may be placed flat on top 18 or tilted at an angle on cross-bar 76. As shown in FIG. 9, weights 68 on bar 64 may be removable, and if weighted, assembled on bar 64 as appropriate to the intended user in color-coded order, like a baby's stacking ring toy. During utilization of dumbbell 54, user 20 reclines on padded seat 84 with his or her back and buttocks contacting the bench. After user 20 has positioned himself on the bench, he grabs bar 64 with both hands, presses dumbbell 54 upwardly away from cradles 62 and slightly forward toward his feet until he is supporting the dumbbell above his chest with his arms fully extended. At that point he lowers the dumbbell to a point adjacent his chest and then raises the dumbbell until his arms are again fully extended, i.e., he performs a "bench press." After a desired number of bench presses are performed, user 20 returns dumbbell 54 to cradles 62 at the top of upstanding members 52. When back portion 86 of seat 84 is inclined, the exercise is especially effective for toning the muscles of the upper part of the chest. When seat 84 is flat, bench press exercises work the middle portion of the chest.

From the above, it will be apparent that dumbbell 54 may be removed from cradles 62 and also used for various floor exercises such as arm curls, etc. as will occur to those knowledgeable about fitness training.

Figure 4:
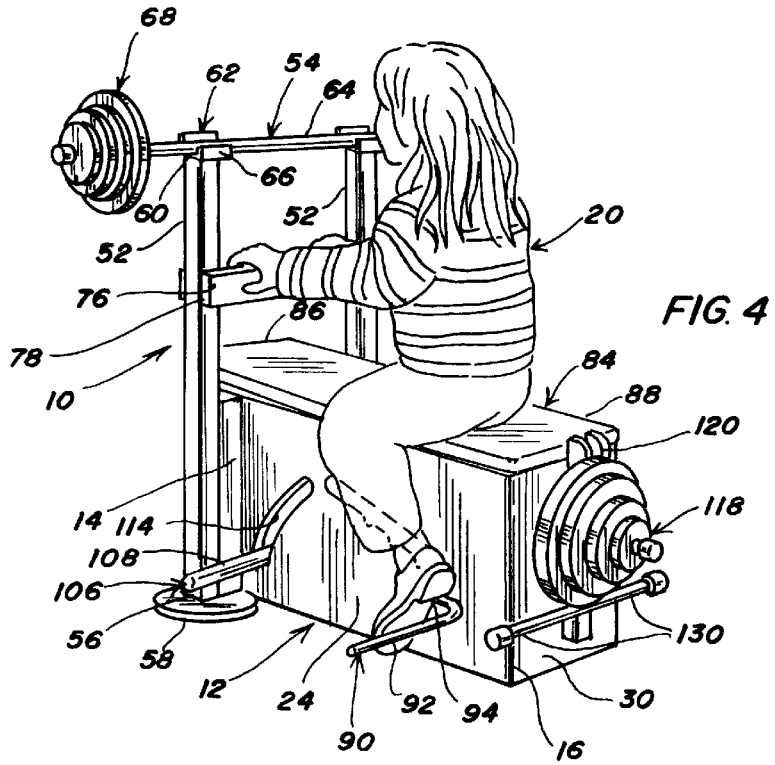
FIG. 4 is a perspective view of the bench showing a user doing stationary cycle exercises.

When aerobic exercise device 90 is provided on bench 10, the distance between axle 96 and top 18 can be adjusted to the length of user's arms or legs, providing a full range of foot/arm motion activities, depending on whether the device is used as a windlass arm exercise device or as a stationary cycle. When aerobic exercise device 90 is used as a windlass arm exercise device as shown in full lines in FIG. 3, user 20 lies in prone position on seat 84 which may be flat or slightly angled. As shown in FIG. 4, aerobic exercise device 90 can also be used to simulate a stationary cycle, in which case user 20 may face first end 14 and use cross-bar 76 as a handlebar. As will be readily apparent, however, the user may face second end 16 and ride without handlebars simulating a unicycle, if desired, or leg extension device 118 may be flipped up and transversely extending supports 130 used as handlebars.

If resistance arm lift exercise device 106 is provided on bench 10, it may be used as shown in broken lines in FIG. 3, user 20 lying prone on seat 84 to simulate exercises that he may see his role model doing on a rowing machine or possibly a cable machine.

Leg extension device 118, if present on bench 10, can be used to strengthen the front muscles of the leg. As with dumbbell 54, weights 68 can be placed on support rod 132 appropriate to the user. As shown in FIG. 2, user 20 sits at second end 16 and dangles his or her feet over the edge of seat 84 and then pushes the front of the ankles against transversely extending supports 130 and lifts up. If an over-center return mechanism is provided on arm 122, leg extension device 118 can also be used for doing leg curls. In which case, user 20 lies flat on his or her stomach and hooks both legs under transversely extending supports 130, raising them towards the buttocks to develop the hamstring muscles.

As will be apparent from the above, bench 10 can be used to simulate most of the activities that user 20 may see a family member performing in even a very-well outfitted gym. This versatility is compactly furnished in a single toy occupying no more space than a child's scooter. In addition, bench 10 can also provide toy storage space accessible through hinged top 18 or hinged upper section 32 as shown in the drawings.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A toy exercise bench comprising:

a frame with first and second end walls, first and second side walls and a generally horizontal top wall upon which a user can lie or be seated;

a free weight exercise device comprising a pair of spaced apart upstanding members at the first end wall of the frame and a dumbbell, each of said upstanding members having a top end with a cradle for receiving a bar of the dumbbell and supporting the dumbbell above the top wall of the frame; and, an aerobic exercise device comprising a pair of pedals mounted on crank arms to an axle, said axle mounted in the frame between the side walls, under the horizontal top wall and between the first and second end walls of said frame, said side walls having an upwardly angled slot with a plurality of journals in which the axle may be mounted at different distances from said top wall, whereby a user can simulate free weight bench-press exercises with the dumbbell and aerobic exercises with the pedals.

2. The toy exercise bench of claim 1 further comprising a leg extension exercise device, said leg extension exercise device comprising a support bracket mounted at the second end wall of the frame, an arm with first and second ends, said first end of the arm pivoted in the support bracket and said second end of the arm having a pair of transversely extending supports adapted to be engaged by the feet of a user.

3. The toy exercise bench of claim 1 further comprising a resistance arm lift exercise device, said resistance arm lift exercise device comprising a pair of transversely extending, interconnected handles adapted to be engaged with the hands of a user, said handles connected to an elastic member attached to the frame under the top wall for imparting progressively increasing resistance as a user pulls the handles closer to the top.

4. A toy exercise bench comprising:

a frame with first and second end walls first and second side walls, a generally horizontal top wall upon which a user can lie or be seated and a bottom wall, said top wall pivotally connected to one of the end walls or one of the side walls providing access to a hollow interior of the frame;

a free weight exercise device comprising a pair of spaced apart upstanding members at the first end wall of the frame and a dumbbell, each of said upstanding members having a top end with a cradle for receiving a bar of the dumbbell and supporting the dumbbell above the top wall of the frame; and, a resistance arm lift exercise device, said resistance arm lift exercise device comprising a pair of transversely extending, interconnected handles extending through a pair of slots in the side walls and adapted to be engaged with the hands of a user, said handles connected to an elastic member attached to the bottom wall for imparting progressively increasing resistance as a user pulls the handles closer to the top surface whereby a user can simulate free weight bench-press exercises with the dumbbell and arm lift exercises with the handles.

5. The exercise bench of claim 4 further comprising a leg extension exercise device, said leg extension exercise device comprising a support bracket mounted at the second end wall of the frame, an arm with first and second ends, said first end of the arm pivoted in the support bracket and said second end of the arm having a pair of transversely extending supports adapted to be engaged by the feet of a user.

6. A toy exercise bench comprising:

a frame with a rectangular bottom wall, first and second rectangular side walls, first and second rectangular end walls and a generally horizontal top wall upon which a user can lie or be seated;

a free weight exercise device comprising a pair of spaced apart upstanding members at the first end wall of the frame and a dumbbell, each of said upstanding members having a top end with a cradle for receiving a bar of the dumbbell and supporting the dumbbell above the top wall of the frame, and a vertically adjustable horizontal cross-bar between the upstanding members, opposite ends of which are forked for receipt of the upstanding members; and, an aerobic exercise device comprising a pair of pedals mounted on crank arms to an axle, said axle mounted in the side walls in a pair of upwardly angled slots, said slots aligned and having a plurality of journals in which the axle may be placed, said axle under the horizontal top wall and between the first and second end walls of said frame whereby a user can simulate free weight bench-press exercises with the dumbbell and aerobic exercises with the pedals.

7. The exercise bench of claim 6 wherein the dumbbell has a bar with a plurality of colored bands at opposite ends thereof and a pair of weights, said weights comprising a plurality of discs correspondingly color coded to the bands on the bar for assisting the user in the proper assembly of the dumbbell.

8. The exercise bench of claim 6 wherein the side walls have upper and lower sections, said upper section connected to the lower section by a hinge provided in the second end wall, said journals comprising a plurality of sockets provided along a top side face of the lower section, said upper section pinning the axle in a select pair of sockets when the upper section is closed over the lower section.

9. The exercise bench of claim 8 wherein the hinge is stiff and comprises a plurality of mating U-shaped yokes with inner faces and tangs with outer faces, said inner and outer faces having a mating protuberance and dimple and a mating rib and radially spaced grooves.

10. The exercise bench of claim 6 wherein the horizontal top wall is hinged to one of the side walls and said hinge is stiff and comprises a plurality of mating U-shaped yokes with inner faces and tangs with outer faces, said inner and outer faces having a mating protuberance and dimple and a mating rib and radially spaced grooves.

11. The exercise bench of claim 6 wherein the slots have a width sufficient for the pedals to be passed through the slots.

12. The exercise bench of claim 11 wherein the journals for the axle comprise a plurality of sockets provided along a bottom side edge of the slots, each socket including a spring clip or an entryway marginally smaller than the axle serving as a journal within which the axle can be seated.

13. The exercise bench of claim 6 further comprising a resistance arm lift exercise device, said device comprising a pair of transversely extending, interconnected handles adapted to be engaged with the hands of a user, said handles extending through a pair of slots in the side walls and connected to an elastic member attached to the bottom wall for imparting progressively increasing resistance as a user pulls the handles closer to the top.

14. The exercise bench of claim 13 wherein the elastic member is a pair of plastic tubes attached to the bottom wall of the frame and the handles.

15. The exercise bench of claim 14 further comprising a leg extension exercise device, said leg extension exercise device comprising a support bracket mounted on the second end wall, an arm with first and second ends, said first end of the arm pivoted in the support bracket and said second end of the arm having a pair of transversely extending supports adapted to be engaged by the feet of a user.

16. The exercise bench of claim 15 wherein the arm has a support rod with a plurality of colored bands and a weight comprising a plurality of discs correspondingly color coded to the bands on the support rod for assisting the user in the proper assembly of the weight on the leg extension exercise device.

* * * * *